US007555849B2

(12) United States Patent
Canvin

(10) Patent No.: US 7,555,849 B2
(45) Date of Patent: Jul. 7, 2009

(54) FOOTWEAR AND INSOLE THEREFOR

(76) Inventor: Lorne Canvin, Box 20063, Winnipeg, Manitoba, R3K 2E5 (CA)

( * ) Notice: Subject to any disclaimer, the term of this patent is extended or adjusted under 35 U.S.C. 154(b) by 320 days.

(21) Appl. No.: 10/566,699

(22) PCT Filed: Aug. 3, 2004

(86) PCT No.: PCT/CA2004/001447

§ 371 (c)(1),
(2), (4) Date: Feb. 1, 2006

(87) PCT Pub. No.: WO2005/011542

PCT Pub. Date: Feb. 10, 2005

(65) Prior Publication Data

US 2006/0242860 A1 Nov. 2, 2006

(30) Foreign Application Priority Data

Aug. 1, 2003 (CA) ..... 2436368

(51) Int. Cl.
*A43B 13/38* (2006.01)

(52) U.S. Cl. ..... 36/43; 36/88; 36/140

(58) Field of Classification Search ..... 36/43, 36/44, 88, 71, 140, 93, 35 R, 37
See application file for complete search history.

(56) References Cited

U.S. PATENT DOCUMENTS 2,502,774 A * 4/1950 Alianiello ..... 36/28
2,637,122 A * 5/1953 Baer ..... 36/173
2,857,689 A * 10/1958 Van Ostrom et al. ..... 36/176
4,408,402 A * 10/1983 Looney ..... 36/43
4,557,060 A * 12/1985 Kawashima ..... 36/44
4,627,177 A * 12/1986 Meyers ..... 36/43
4,627,178 A * 12/1986 Sullivan et al. ..... 36/44
4,718,179 A * 1/1988 Brown ..... 36/44
4,769,926 A * 9/1988 Meyers ..... 36/43
4,793,078 A * 12/1988 Andrews ..... 36/43
4,962,593 A * 10/1990 Brown ..... 36/44
RE33,648 E * 7/1991 Brown ..... 36/44
5,063,692 A * 11/1991 Suginaka ..... 36/43
5,138,774 A 8/1992 Sarkozi (Continued)

FOREIGN PATENT DOCUMENTS

WO WO 92/21258 12/1992

*Primary Examiner*—Marie Patterson
(74) *Attorney, Agent, or Firm*—Ade & Company Inc.; Ryan W. Dupuis; Kyle R. Satterthwaite

(57) ABSTRACT

An article of footwear is provided in which the footbed is formed from a shoe last which is considerably thicker at the metatarsal region than conventional footwear permitting a much thicker insole to be received within the footbed. The thicker insole of a ⅜" or greater throughout permits a range of different durometers of material to be used to ensure that maximum compression of the material is not reached through a stepping motion of a user of the footwear. A metatarsal insert and a combined heel and arch insert are received within respective cavities in a body of the insole so that durometers of the heel, arch and metatarsal region of the insole can be customized to a particular user's needs. The combined effect of the resulting thicker insole and varying durometers of the inserts therein results in a users applied weight being substantially evenly distributed across an entire footprint of the footwear during a stepping motion.

14 Claims, 5 Drawing Sheets

U.S. PATENT DOCUMENTS

| | | | | |
|---|---|---|---|---|
| 5,146,698 | A * | 9/1992 | Tilles et al. | 36/44 |
| 5,394,626 | A * | 3/1995 | Brown | 36/99 |
| 5,438,768 | A * | 8/1995 | Bauerfeind | 36/44 |
| 5,695,850 | A * | 12/1997 | Crow | 428/139 |
| 6,000,147 | A * | 12/1999 | Kellerman | 36/44 |
| 6,120,880 | A * | 9/2000 | Crow | 428/167 |
| 6,176,025 | B1 * | 1/2001 | Patterson et al. | 36/28 |
| 6,205,685 | B1 * | 3/2001 | Kellerman | 36/44 |
| 6,253,469 | B1 | 7/2001 | Atlani et al. | |
| 6,453,578 | B1 * | 9/2002 | Yung et al. | 36/43 |
| 6,502,330 | B1 * | 1/2003 | David et al. | 36/88 |
| 6,519,874 | B1 | 2/2003 | Dean | |
| 6,589,630 | B1 * | 7/2003 | Crow | 428/167 |
| 6,662,469 | B2 | 12/2003 | Belley et al. | |
| 2001/0039746 | A1 * | 11/2001 | Seiter | 36/44 |
| 2002/0007569 | A1 | 1/2002 | Crane et al. | |
| 2002/0083618 | A1 * | 7/2002 | Erickson et al. | 36/44 |
| 2003/0009915 | A1 * | 1/2003 | Bacon | 36/44 |
| 2003/0070321 | A1 * | 4/2003 | Davis et al. | 36/43 |
| 2004/0078998 | A1 * | 4/2004 | Davis et al. | 36/44 |
| 2004/0103561 | A1 * | 6/2004 | Campbell et al. | 36/88 |
| 2004/0181971 | A1 * | 9/2004 | Turkbas et al. | 36/44 |
| 2006/0005428 | A1 * | 1/2006 | Lebo | 36/43 |
| 2006/0026864 | A1 * | 2/2006 | Arbeiter | 36/29 |

* cited by examiner

FOOTWEAR AND INSOLE THEREFOR

This application is a national phase firing of PCT/CA2004/001447 and claims foreign priority benefits from Canadian Patent Application 2,436,368 filed Aug. 1, 2003.

FIELD OF THE INVENTION

The present invention relates to footwear and more particularly relates to an orthotic insole for improved comfort and for providing an improved method of sizing an article of footwear to the foot of a person using the orthotic insole.

BACKGROUND

Many types of strain or injuries have been known to be associated with footwear which provides inadequate support or support which is poorly tailored to a particularly wearer of the footwear. While custom orthotics are known for attempting to correct the inadequacies of support to the wearer, known footwear is generally too constrained to provide proper space for a proper orthotic insole and does not provide sufficient insole variance to address the needs of wearers of the footwear.

Dimensions of shoe lasts generally have not changed since the beginnings of mass production of shoes and footwear in general. Many accommodations have been made to the outsoles for various activities including various durometers of materials, thicker and more textured bottom surfaces of the outsoles and variations to the overall shape thereof, but none of these variations to the outsoles permit any customization in the end product for suiting a particular user.

Any known removable inserts which might be customized are limited to the dimensions provided by conventional size shoe lasts which limit the size of the inserts, particularly at the metatarsal region. This limitation in thickness also in turn limits the material durometer which can be used effectively within this limited space as thicker materials are required to be considerably compressed if the user's foot is to be received comfortably within conventional footwear formed from standard size shoe lasts.

SUMMARY

According to one aspect of the present invention there is provided an article of footwear comprising:

an outsole for engaging the ground;

a shoe body supported on the outsole, including an internal foot bed for receiving a foot of a person therein; and an insole having a depth which is at least ⅜ inch at a metatarsal region thereof for supporting the foot of the person thereon;

the foot bed having an internal height which is suitably sized for comfortably receiving therein both the insole and the foot of the person supported on the insole.

According to a second aspect of the present invention there is provided an article of footwear comprising:

an outsole for engaging the ground;

a shoe body supported on the outsole, including an internal foot bed for receiving a foot of a person therein; and an insole for supporting the foot of the person thereon;

the insole being formed of a material having a maximum compression defined when additional force applied to the insole results in a substantially reduced rate of compression of the material;

the insole having a thickness and a durometer at a metatarsal region thereof such that the maximum compression is not reached when the insole is stepped on by an adult person of average weight;

the foot bed having an internal height which is suitably sized for comfortably receiving therein both the insole and the foot of the person supported on the insole.

Varying characteristics of the insole may include variations to durometer, thickness, footbed width, shape, heel suspension, arch support or any combination thereof. A deeper interior in the shoe body for receiving a thicker insole having a minimum thickness throughout in the order of ⅜ of an inch to ¾ of an inch is preferred to permit maximum variability to the insole. Variations to the insole may be accomplished by provided numerous varying insoles associated with each article of footwear or by providing a common insole body associated each article of footwear which is adapted to receive varying inserts therein to provide the ability to have insoles of numerous differing characteristics.

Preferably, the insoles are readily selectively separable from the outsole for replacement thereof with ones of differing characteristics at the factory or in retail markets.

Thickness of the insole at the metatarsal region and at a centre of a heel region are preferably substantially identical, with thickness at an arch of the insole being plural times thickness at the heel region.

The foot bed preferably has an internal height of at least 2 inches at the metatarsal region, resulting in a ratio of height at the metatarsal region to length of the foot bed being at least 0.2 and a ratio of height at the metatarsal region to width at the metatarsal region of the foot bed being at least 0.55.

The insole preferably has an average durometer as measured on the Ashore hardness scale of between 6 and 20.

Preferably the insole comprises an insole body and at least one insert arranged to be received within the insole body and having a durometer which varies from durometer of the insole body.

Said at least one insert may include a metatarsal insert which is located at a metatarsal region of the insole and a heel and arch insert which spans a heel region and an arch region of the insole.

The metatarsal insert is preferably substantially equal in hardness or stiffer than the insole body. Alternatively, the heel and arch insert is preferably less stiff than the insole body.

Preferably, the insole comprises an insole body, having a hardness measured on the Ashore hardness scale between 15 and 20, receiving a metatarsal insert, having a hardness measured on the Ashore hardness scale between 15 and 34, at a metatarsal region of the insole and a heel and arch insert, having a hardness measured on the Ashore hardness scale between 8 and 25, spanning a heel region and an arch region of the insole, the insole having a minimum thickness of ⅜ inch throughout.

The insole may be raised upwardly on opposing sides at a metatarsal region thereof.

An average thickness of the insole may be between ⅜ of an inch and ¾ of an inch, but preferably the insole has a minimum thickness of approximately ½ inch, and more preferably the insole has an approximate thickness of ¾ inch.

According to a further aspect of the present invention there is provided a method of sizing an article of footwear to a foot of a person, the method comprising:

providing multiple articles of footwear each having a shoe body with differing internal dimensions and an outsole;

providing a set of insoles associated with each article of footwear which is suitably sized to be received within the internal dimensions of the article of footwear, each insole of the set having differing characteristics than remaining insoles of the set;

selecting an article of footwear having internal dimensions which most closely accommodates the foot of the person; and selecting an insole, of the set of insoles associated with the selected article of footwear, having characteristics which are most closely matched to characteristics of the foot of the person.

The insoles of each set may have differing durometer. The insoles of each set may also have differing foot bed dimensions upon which the foot rests.

When the insoles are raised upwardly on opposing sides at a metatarsal region thereof, the insoles of each set preferably have differing internal dimensions between the opposing sides thereof at the metatarsal region.

The set of insoles may comprise a single insole body and a plurality of inserts, each arranged to be received within the insole body to vary the characteristics of the single insole body.

The inserts may be received in mating recesses in a bottom side of the insole body, the inserts being reduced in cross sectional dimension at a bottom side thereof in relation to a main portion thereof for wedging the inserts within the respective mating recesses.

BRIEF DESCRIPTION OF THE DRAWINGS

In the accompanying drawings, which illustrate an exemplary embodiment of the present invention.

DETAILED DESCRIPTION

Figure 1:
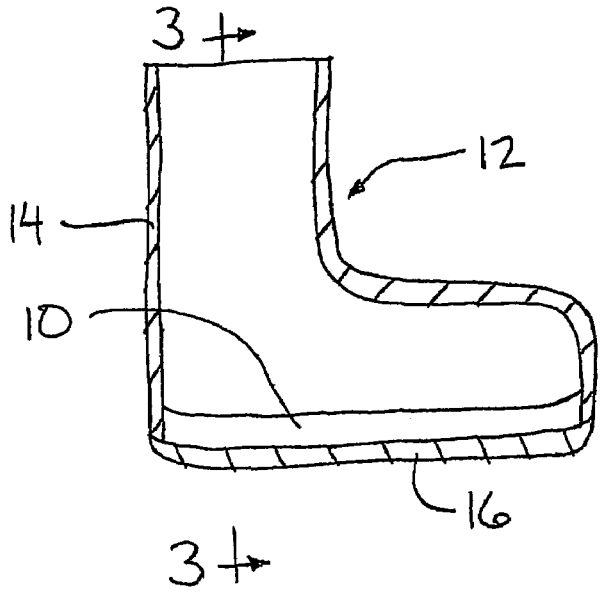
FIG. 1 is a partly sectional side elevational view of an article of footwear including the insole of the present invention received therein.
Figure 3:
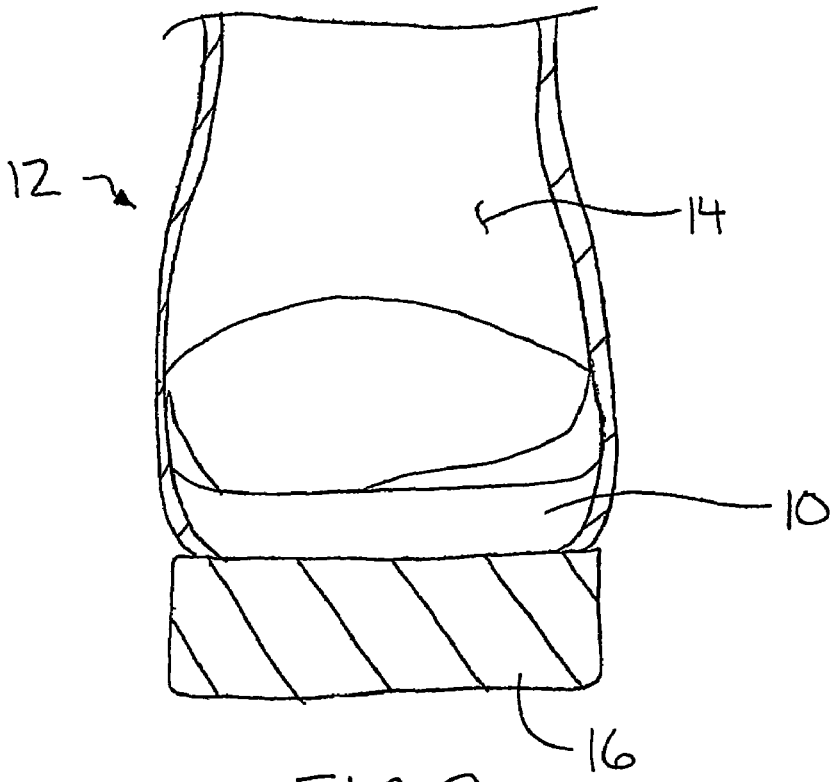
FIG. 3 is a partly sectional rear elevational view of the article of footwear receiving the insole therein.
Figure 2:
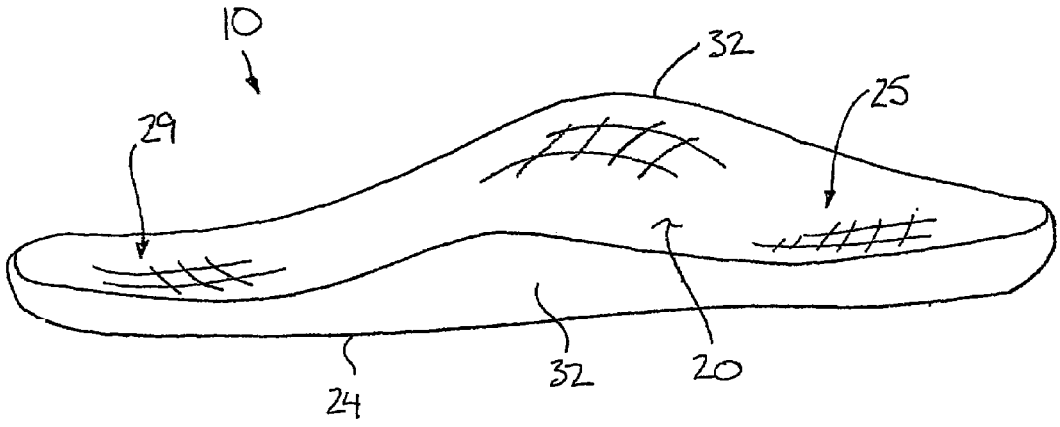
FIG. 2 is a perspective side view of the insole.
Figure 4:
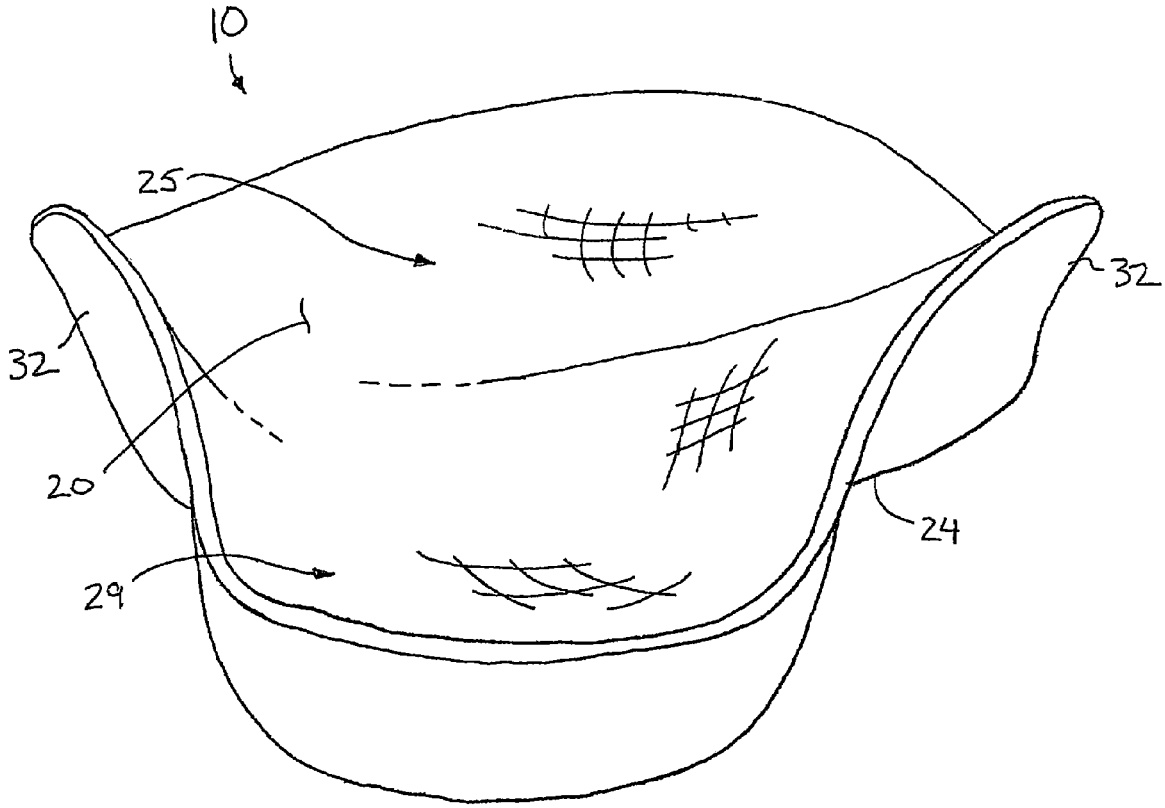
FIG. 4 is a rear perspective view of the insole.
Figure 5:
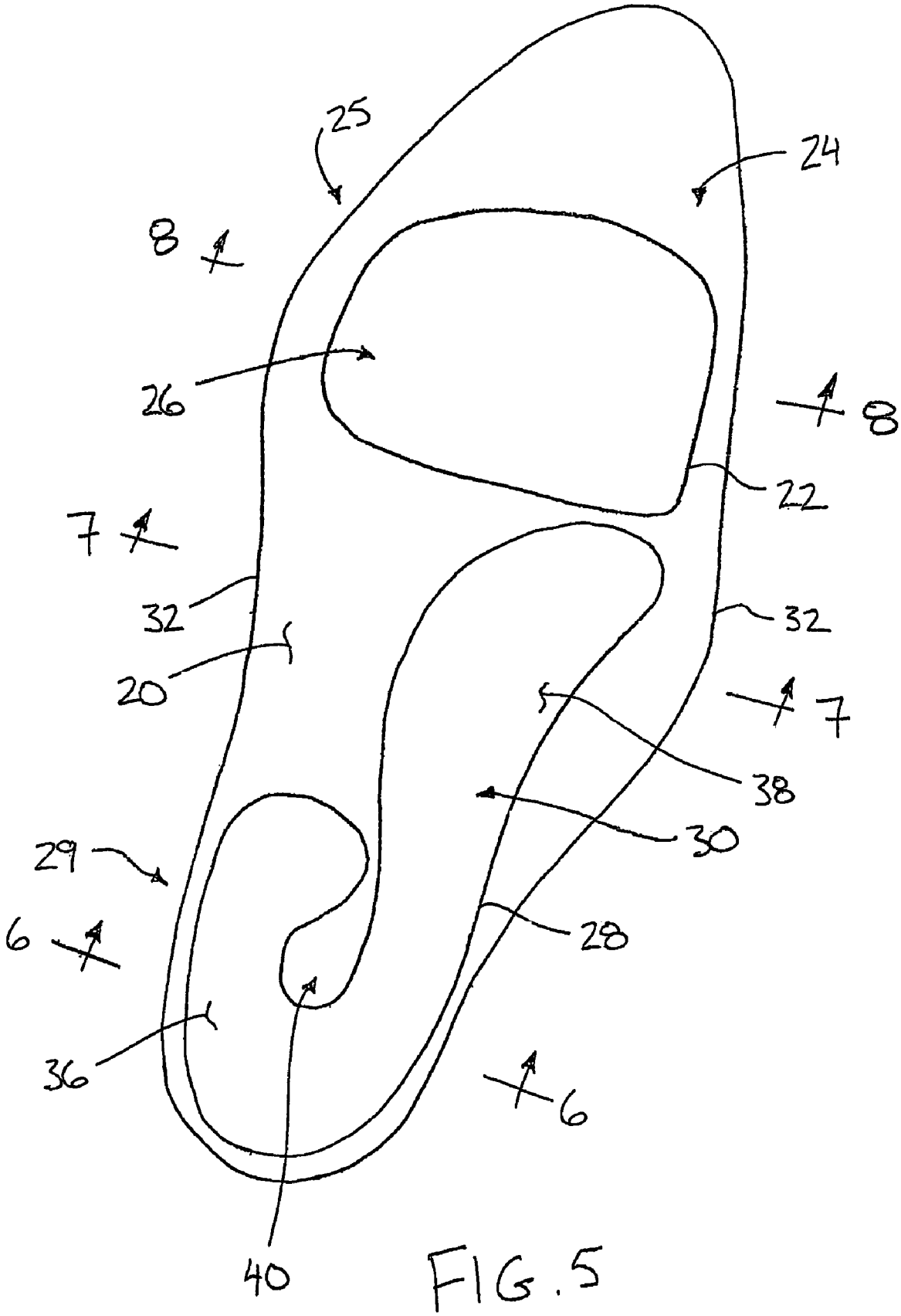
FIG. 5 is a bottom plan view of the insole.
Figure 6:
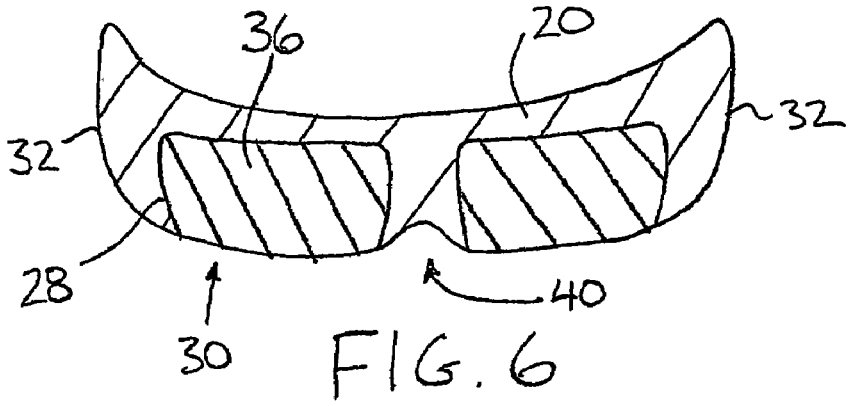
FIG. 6 is a sectional view along the line 6-6 of FIG. 5.
Figure 7:
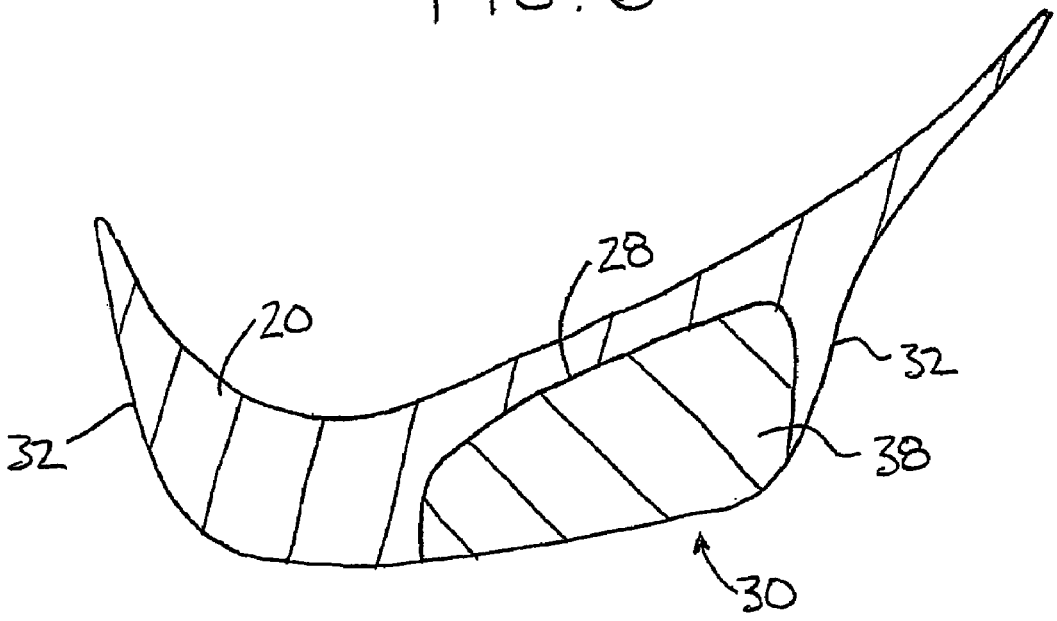
FIG. 7 is a sectional view along the line 7-7 of FIG. 5.
Figure 8:
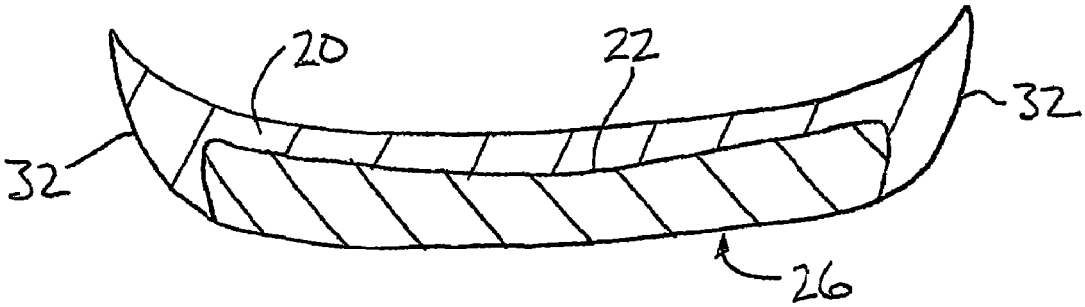
FIG. 8 is a sectional view along the line 8-8 of FIG. 5.

Referring to the accompanying drawings, there is illustrated an orthotic insole generally indicated by reference numeral 10. The insole is intended for use in an article of footwear 12 to provide generally uniform support to the foot of a person. The insole 10 permits the article of footwear 12 to be readily customized by the end user by simply selecting appropriate support characteristics of the insole which most closely match the requirements of the wearer.

The article of footwear 12 has a main shoe body 14 and an outsole 16 as found in common articles of footwear. The article of footwear 12 differs in that it has an especially deep foot bed for accepting thick insoles having a generally uniform thickness possibly in the order of one inch or more while still providing sufficient space or height within the article of footwear to readily accept the foot of the wearer therein. This is achieved by manufacturing footwear by conventional techniques but with a shoe last which is thicker than conventional shoe lasts by at least 1 cm and by as much as 1 inch (2.5 cm).

The insole 10 as illustrated, is formed of polyurethane and EVA injection moulded foam having a substantially constant minimum thickness averaging between ⅜ of an inch and ¾ of an inch. The insole includes a main body 20 formed of the polyurethane material and having a metatarsal cavity 22 in a bottom side 24 thereof at a metatarsal region 25 for receiving a metatarsal insert 26 therein. A heel and arch cavity 28 is similarly provided in the bottom side of the body 20 of the insole at a heel region 29 for receiving a corresponding heel and arch insert 30.

Both of the inserts 26 and 30 are formed of the EVA Injection moulded foam and are arranged to mate with the respective cavities in the body 20 of the insole in a snugly fitting configuration. The inserts may be formed of a different material than the body of the insole to provide variations in durometer to the insole. The inserts 26 and 30 each have a decreasing cross sectional area at a bottom side thereof for mating with a narrower mouth portion of the respective cavity in the body of the insole. The narrower mouth of the cavities permit the respective inserts to be wedged therein for retaining the inserts within the body of the insole.

The metatarsal insert 26 is arranged to span substantially the width of the body 20 of the insole at the metatarsal region thereof between opposing sides 32 of the insert. The insert 26 comprises most of the overall thickness of the insole once it is received with the respective cavity in the body of the insole and typically has a durometer which differs from the durometer of the body.

The heel and arch insert 30 generally comprises a single piece of moulded material including both a heel cup portion 36 and an arch portion 38 which are integrally formed. The heel cup portion 36 is defined by a U-shaped section having an open side facing a toe end of the insole. A recess 40 is defined within the U-shaped contour of the heel cup portion. The recess 40 is suitably sized for suspending a central portion of the heel of the person therein. The body 20 of the insole spans the recess 40 in the heel and arch insert.

The arch portion 38 is formed continuously with the heel cup portion, extending from an inner one of the legs of the U-shaped heel cup portion. The arch portion is formed of the same material and accordingly has the same durometer as the heel cup portion. The arch portion 38 is plural times thicker than the heel cup portion, contributing to the insole being much thicker at the arch than at the heel.

The footwear and insole as described herein include numerous advantages, including a larger foot bed due to the use of an expanded last dimension around which the shoe or boot is made. Over the years last dimensions of shoes and boots has not changed, making it impossible to add any meaningful support to the forefoot. Creating a substantially deeper foot bed is crucial to designing any support for the fore foot.

Together with a deeper foot bed the present invention now has the ability to include a thicker insole. In all the prior art of shoe making the dimensional space created by the last did not allow for a larger, thicker insole.

The purpose of such a thicker insole has three main aspects, they are as follows:

A. Corrective Orthotic

The thicker dimensions of this insole allow the present footwear to correct the gait of the individual by altering the strike pattern of the foot. The elevations required to accomplish this are not present in other shoes or their insoles.

B. Shock Absorbing Qualities

Current prior art has an insole thickness of approximately 0.187 inch. This is not nearly enough to absorb the shock or impact of the average 170 pound man. Any impact not taken up by the shock absorbing qualities of the footwear is automatically distributed throughout the body. This impact will over time hurt the ankles, knees, hips and back causing a deterioration of joint tissues. The walking or running stride of a stepping motion results in approximately 3 times the full body weight to be applied to the bottom of the feet.

Nearly 60-80% of this force is distributed between the calcaneus, the first and fifth metatarsals. Due the very small area of pressure and the relatively high pounds per square inch of force applied, these three structures tend to break down the insoles ability to absorb shock. Therefore, the shock absorbing qualities of the 0.187 inch insole thickness is far exceeded by the dynamic weight of the individual. The insole of the present invention has a thickness dimension of approximately 0.75 inch, giving it more than 4 times the shock absorbing potential.

C. Functionally Alterable

The insole according the present invention combines the thickness and the appropriate durometer of material to maximize its shock absorbing abilities. By including interchangeable inserts the insole has the ability to accommodate the weight and dynamic forces created by any person.

Figure 9:
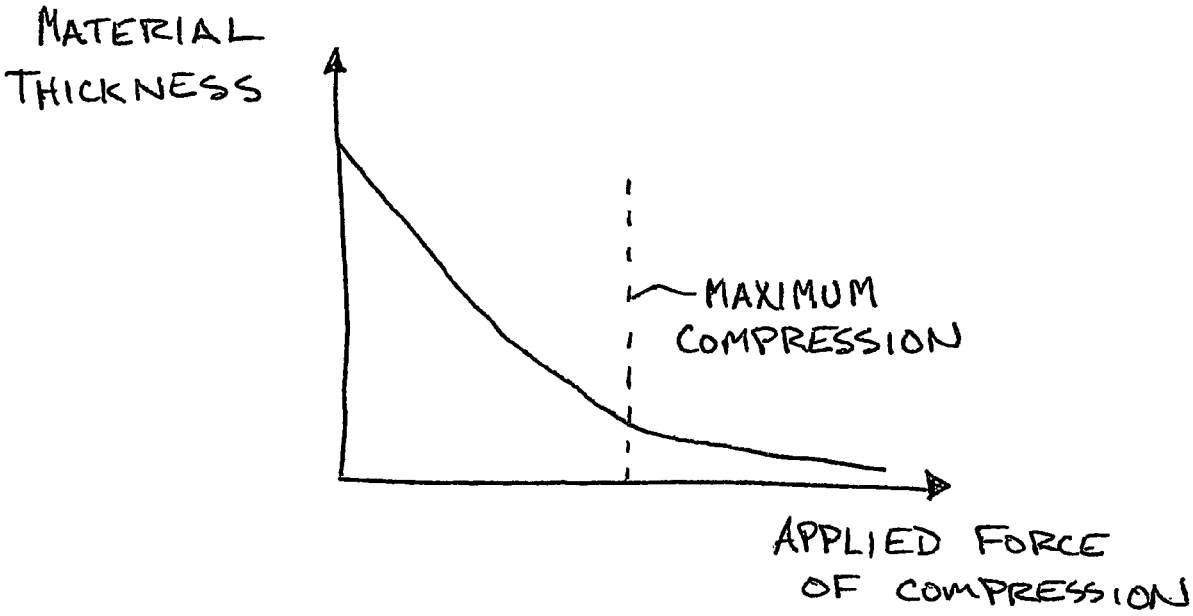
FIG. 9 is a schematic illustrating characteristics of the insole material.

This is accomplished by providing an insole of sufficient thickness and durometer throughout (including the metatarsal region) that the force of an adult person of average weight through a stepping motion on the insole does not exceed maximum compression of the material forming the insole. As noted in FIG. 9, the maximum compression is defined as the point in the curve of Material Thickness vs. Applied Force of Compression for a given material at which the slope of the curve changes considerably due to the material having reached a point at which further applied force results in relatively minimal further compression and accordingly the rate of compression is significantly reduced;

The thicker insole of the appropriate durometer can quantifiably improve the functioning of most footwear provided that this footwear is equipped to accommodate the larger insole dimensions.

As noted above, the footwear according to the present invention includes the following characteristics:

1. Deeper Foot Bed

The construction of a larger foot bed is accomplished through the development of a deeper and broader last on which the footwear is made. The size of this last is substantially larger than what is currently accepted in the industry.

2. Thicker Insole

The larger foot bed is able to accommodate a larger more substantial insole. The insole is nearly 0.75 inches thick and is contoured to support the heel, arch and the metatarsals of the foot.

3. Removable and Interchangeable Inserts

Each of the high impact or high pressure areas of the foot is equipped with a removable or interchangeable insert installed at the time of manufacture or by the retail customer. These inserts may be constructed of dissimilar materials in order to provide the greatest comfort and functionality. e.g. A heavier person will require an insert of denser durometer thereby maintaining the proper dynamic support. An individual who has flatter feet will be able to soften the arch by reducing the density of the arch material. Areas which are specifically addressed include: the Metatarsals, the Arch and the heel cup.

4. Posting (Corrective) Insert

The insole will be able to include a posting insert for the heel to act against over pronation and supination. These inserts may be placed by the user through the instruction of an educational CD ROM.

5. Extended Insole Boarders

At strategic locations the insole edges will be extended up and outward while thinning toward the outer edge of the insert. The purpose of this is to contain the foot within the shoe or boot in any dynamic circumstance, thereby preventing the foot from shifting or sliding about. The second reason for this extension is to accommodate a greater range of foot widths with in the same larger foot bed.

In an example for demonstrating the usefulness of the present invention, a 200 lb man will generate forces over 2.5-3 times his body weight resulting in forces in excess of 600 lbs at heel strike. This high impact force or pressure is normally absorbed by the person's heel tissues due to the lack of adequate cushioning in the heel of the boot or shoe. This impact force occurs in approximately 0.12 of a second and if a shoe or boot is intended to absorb more of this impact heel force, a thicker heel pad is required. This pad allows impact forces to be controlled more effectively by distributing the forces over a longer period of time. The insole of the present invention is 100-150% thicker at a center of the heel and 200-300% thicker at the edges compared to all other insoles in the market place. This feature increases the amortization time at impact by more than 100% resulting in a 0.24-0.30 second impact absorption time period.

The concave heel contour and heel thickness result in an increase in resistance to heel compression. This results because a combination of the thicker heel and the concave contour results in an, increase in the amount of surface area used to absorb the forces. This increase occurs as the materials in the heel are compressed by the heel impact. Two important things occur in the insole according to the present invention:

A. More material and durometer variations in the heel increase the impact absorbing time.

B. The concave contour coupled with compression of the enhanced materials in the heel increase the area of absorbsion with increasing resistance.

The arch support, or heel and arch insert, provides a dynamic support of an individual's arch and works in combination with the heel contour to redirect the forces being applied to the foot. The insert uses the thickness and the functional nature of the durometer of insert materials to lift and support the arch with enough flex to allow the person the walk and run in comfort. The arch height varies over the designs, however the thickness of the arch of the present invention is far greater than existing products in the market. The current arch height is 1 inch-1.25 inches in contrast to other competitive product at 0.187-0.375, representing an increase of 230-450%. The durometer or softness variations allow the arch to compress thereby providing a dynamic support while redirecting forces.

Two thirds of the time the foot spends on the ground is on the fore foot metatarsal area. The time integral for forces on the forefoot is approximately 0.36-0.55 seconds. This condition leads to many of the forces being concentrated on the first metatarsal head which supports a minimum of ⅙ of the total body weight. The premise of absorbing forces in the metatarsal area is the same as the heel minus all the impact. The greater the compression of the forefoot area the more surface area is being used to absorb the forces resulting in a reduction of 40-50% of the forefoot pressure.

The combined effort of the heel, arch and forefoot contours work dynamically with the material durometers or softness to absorb the greatest forces and distributing the remaining forces to areas that are better able to support them.

The effect of all of these features working in unison is an effective reduction of both impact and integral pressures in the magnitude of 40-60% over all types of walking and running. This is not done by any other type of current footwear and would not be possible without each of the aforementioned features.

When used as a kit, the insoles 10 can be sold with footwear in sets having varying characteristics, but still having outer dimensions suitably sized and associated with the foot bed of a particular size of article of footwear. A person would thus select the size of footwear article which most closely matches the size of the foot of the person along with the appropriate set of insoles belonging to that particular size of article of footwear. For proper fitting, one insole of the set is selected for each article of footwear in a pair having characteristics which most closely match the desired characteristics by the wearer. The selection is based upon either a desired durometer which may vary between the inserts or the body of the insoles. The particular shape and size of the insole can also be varied within the insoles of a particular set by providing different heel and arch combinations as well as varying internal widths between opposing sides of the metatarsal insert. A set of insoles associated with each article of footwear can thus be pre-made or varied by providing variable inserts 26 and 30. Either option would provide a suitable set of insoles associated with each size of article of footwear for optimally customizing support and comfort of the wearer of the article of footwear.

The shape of the insole is suitably arranged to align the force applied to the insole by a person stepping thereon along a longitudinal central line across the insole. The durometer of the insole in turn distributes this force evenly across the surface of the insole so that the force distributed to the footprint of the person walking is much less concentrated than in prior art footwear limited in the thickness of the insole.

In the preferred embodiment, thickness at a center of the heel is approximately ⅜". The thickness remains substantially constant along an outerside of the insole while increasing to plural times the thickness of the center of the heel at the arch. The resulting arch thickness is between ¾ and 1¼" but is ideally at least 1". Beyond the arch towards the toe portion, the thickness of the insole is again reduced to approximately ⅜" similar to the center of the heel portion.

Each of the longitudinally extending inner and outer sides of the insole taper to a narrow thickness extending wider at the metatarsal region than the conventional width of the foot bed of the footwear receiving the insole so that the longitudinally extending sides of the insole curl upwardly against the internal sides of the foot bed of the footwear a thickness up to ⅜". Some support is thus also provided to the sides of the user's foot. The toe portion and the heel portion of the insole similarly include a thin tapered edge which curls slightly upward against the internal walls of the footbed of the footwear.

The metatarsal insert and the heel arch insert have a different durometer than the body of the insole depending upon the desired characteristics for the user wearing the insole in their footwear. As measured on the Ashore hardness scale, the heel and arch insert has a hardness of 8 to 25, the body has a hardness of 15 to 20 and the metatarsal insert has a hardness of 15 to 34. The Ashore hardness scale was used for measurements of the present invention, but it is understood that other scales of hardness, including Asker C or Type O-O may be used to represent comparable hardness values.

Typically the heel and arch insert is softer in durometer than both the body of the insole and the metatarsal insert. The metatarsal insert in turn is typically near the same durometer or is greater in stiffness than the surrounding body. Depending upon desired characteristics however it may be desirable for the heel and arch insert to be softer than the metatarsal insert which is in turn softer.

In either instance, the hardness is selected so that the maximum compression is not reached when the insole is stepped on by an adult person of average weight. An average adult person is intended to comprise any person over 100 lbs. with a commonly available shoe size.

As shown in the accompanying table, increasing the last dimensions so that internal height of the footbed at the metatarsal insert is approximately 1 cm greater, permits a considerably thicker insole to be used within the footwear. The last dimensions may be varied so that the foot pad may be as much as ½ or ¾" greater than conventional footwear to prevent further customization of the insole.

TABLE 1

Shoe Last Dimensions

| | Men's US Sizes | | |
|---|---|---|---|
| | 8 | 9 | 10½ |
| Length (cm) | 25.7 | 26.7 | 27.3 |
| Width @ Metatarsal (cm) | 9.6 | 10.0 | 10.5 |
| Conventional (Old) Height @ Metatarsal (cm) | 4.4 | 4.5 | 4.9 |
| New Height @ Metatarsal | 5.4 | 5.5 | 5.9 |
| Old Height/Length | 0.1712 | 0.1685 | 0.1795 |
| New Height/Length | 0.2101 | 0.2060 | 0.2161 |
| Old Height/Width | 0.4583 | 0.4500 | 0.4667 |
| New Height/Width | 0.5625 | 0.5500 | 0.5619 |

As noted in the table, based on conventional shoe last dimensions, typical ratios of the height at the metatarsal region to the length and to the width are approximately between 0.16 and 0.18 and 0.45 and 0.47 respectively. Alternatively, with the shoe last dimensions of the present invention in which height is increased by approximately 1 cm, new ratios of height at the metatarsal region to length and the same height to the width at the metatarsal region are between 0.20 and 0.22 and between 0.55 and 0.56 respectively. These ratios readily accommodate the greater thickness of insole described herein which is thicker both at the heel portion and at the metatarsal region. The greater thickness, in particular at the metatarsal region, permits a greater durometer to be used at such increased thicknesses as less overall compression is required for the user's foot to be received within the footbed. This combination of greater thickness of the insole and variably greater durometers surprisingly results in a dramatic effect of weight distribution of the user across the fold foot print during a walking motion to reduce stress on the heel and ball of the foot of the user.

While one embodiment of the present invention has been described in the foregoing, it is to be understood that other embodiments are possible within the scope of the invention. The invention is to be considered limited solely by the scope of the appended claims.

The invention claimed is:

1. An article of footwear comprising:

an outsole for engaging the ground;

an insole having an average durometer as measured on the Ashore hardness scale of at least 6; and a shoe body supported on the outsole, including an internal foot bed comprising a space with an internal height arranged to receive both the insole and a foot of a person therein;

the insole having a depth which is at least ⅜ inch at a metatarsal region thereof and being received in the internal foot bed so as to be arranged for supporting the foot of the person thereon;

the internal height of the internal foot bed being at least 2 inches at the metatarsal region and being arranged such that:

a ratio of the internal height of the internal foot bed at the metatarsal region to a length of the internal foot bed is at least 0.2; and a ratio of the internal height of the internal foot bed at the metatarsal region to a width of the internal foot bed at the metatarsal region is at least 0.55.

2. The article of footwear according to claim 1 wherein the insole is selectively separable from the outsole for replacement thereof.

3. The article of footwear according to claim 1 wherein thickness of the insole at the metatarsal region and at a centre of a heel region are substantially identical.

4. The article of footwear according to claim 3 wherein thickness at an arch of the insole is at least two times greater than thickness at the heel region.

5. The article of footwear according to claim 1 wherein the insole comprises an insole body and at least one insert arranged to be received within the insole body and having a durometer which varies from durometer of the insole body.

6. The article of footwear according to claim 5 wherein said at least one insert includes a metatarsal insert which is located at a metatarsal region of the insole.

7. The article of footwear according to claim 6 wherein the metatarsal insert is stiffer than the insole body.

8. The article of footwear according to claim 5 wherein said at least one insert includes a heel and arch insert which spans a heel region and an arch region of the insole.

9. The article of footwear according to claim 8 wherein the heel and arch insert is less stiff than the insole body.

10. The article of footwear according to claim 1 wherein the insole comprises an insole body, having a hardness measured on the Ashore hardness scale between 15 and 20, receiving a metatarsal insert, having a hardness measured on the Ashore hardness scale between 15 and 34, at a metatarsal region of the insole and a heel and arch insert, having a hardness measured on the Ashore hardness scale between 8 and 25, spanning a heel region and an arch region of the insole, the insole having a minimum thickness of ⅜ inch throughout.

11. The article of footwear according to claim 1 wherein the insole is raised upwardly on opposing sides at a metatarsal region thereof.

12. The article of footwear according to claim 1 wherein the insole has an average thickness between ⅜ of an inch and ¾ of an inch.

13. The article of footwear according to claim 1 wherein the insole has a minimum thickness of approximately ½.

14. The article of footwear according to claim 1 wherein the internal height of the internal foot bed corresponds to a height of a shoe last about which the article of footwear is formed.

* * * * *